United States Patent [19]

Tarnacki

[11] 4,251,068

[45] Feb. 17, 1981

[54] EXERCISING DEVICE FOR SKIERS

[76] Inventor: Edward J. Tarnacki, 408 Hudson St., Jermyn, Pa. 18433

[21] Appl. No.: 56,897

[22] Filed: Jul. 12, 1979

Related U.S. Application Data

[63] Continuation of Ser. No. 7,987, Jan. 31, 1979, abandoned.

[51] Int. Cl.[3] ..... A63B 69/18

[52] U.S. Cl. ..... 272/97; 272/70

[58] Field of Search ..... 272/97, 109, 111, 96, 272/70

[56] References Cited

U.S. PATENT DOCUMENTS

| | | | |
|---|---|---|---|
| 1,990,970 | 2/1935 | Wood | 272/96 |
| 2,964,315 | 12/1960 | Dinning | 272/97 |
| 3,462,141 | 8/1969 | Robbins | 272/97 |
| 3,565,424 | 2/1971 | Macabet | 272/97 |
| 3,707,283 | 12/1972 | Cormier | 272/97 |
| 3,708,163 | 1/1973 | Hynes | 272/97 |
| 3,729,207 | 4/1973 | Reynolds | 272/97 |

FOREIGN PATENT DOCUMENTS

| | | | |
|---|---|---|---|
| 2439402 | 3/1976 | Fed. Rep. of Germany | 272/96 |
| 510998 | 1/1955 | Italy | 272/97 |

*Primary Examiner*—Richard J. Johnson

*Attorney, Agent, or Firm*—Frederick E. Bartholy

[57] ABSTRACT

An exercising device for use in conditioning muscles used in the sport of skiing is disclosed. The exercising device may be used indoors or outdoors and is comprised of a platform with an oval shaped body secured beneath the platform. Suitable boot engaging clamps are provided on the platform and are used to secure a ski boot or the like to the platform. The exercising device permits lateral pivotal movement of the body as well as forward tilt.

4 Claims, 3 Drawing Figures

EXERCISING DEVICE FOR SKIERS

This is a continuation of my pending application Ser. No. 7,987 filed Jan. 31, 1979 now abandoned.

This invention pertains to indoor exercising devices, particularly those intended for the sport of skiing, to properly develop the muscles of the body which are used by a skier in all forms of this sport.

Devices for this purpose have been described, for example, in U.S. Pat. Nos. 3,462,141 and 2,964,315. These are complicated and require actual skis and boots. Moreover, a sliding motion is necessary while the individual is training.

As will be seen by the present invention, the user does not slide, but remains in one position. The shape of the exercising device is such that it permits lateral pivotal movements of the body and forward tilt within a given degree which would be assumed by a skier in actual skiing maneuvers. The exercises may be done indoors as well as outdoors.

Accordingly, it is the primary object of this invention to provide a simple device adapted to be attached to boots, enabling the wearer to follow prescribed maneuvers intended for the development of muscles normally called upon for use in the sport of skiing.

It is a particular feature of the invention that the device is structurally extremely simple. Moreover, the invention has the advantage that the device, in accordance therewith, may be manufactured in quantities at considerably low cost.

Other objects, features and advantages will be apparent from the following description of the invention, pointed out in particularity in the appended claims, and taken in connection with the accompanying drawing, in which:

Figure 1:
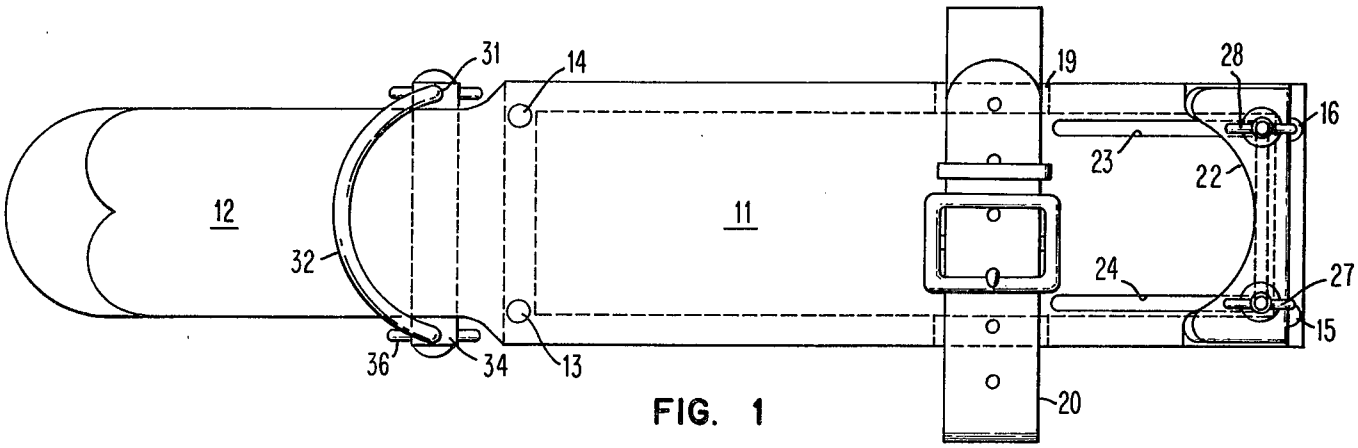
FIG. 1 is a top view of the exercising device, showing the simple attaching and adjusting means for accommodating diverse sizes of ski boots. Since ski boots of various types are well known, illustration thereof has been omitted in order to present a clearer view of the improvements of the device to which this invention is particularly directed.
Figure 2:
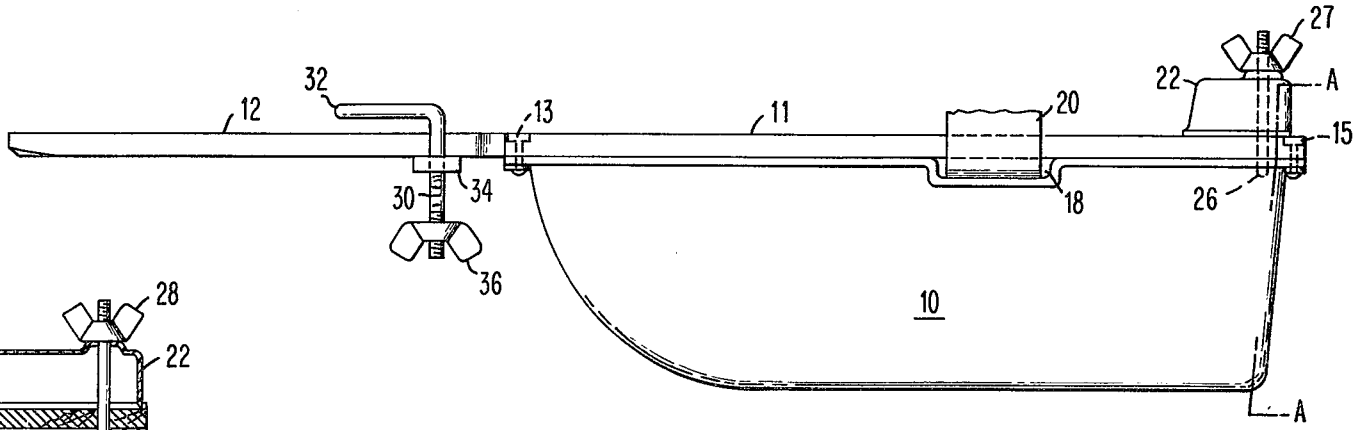
FIG. 2 is a side elevational view of FIG. 1.
Figure 3:
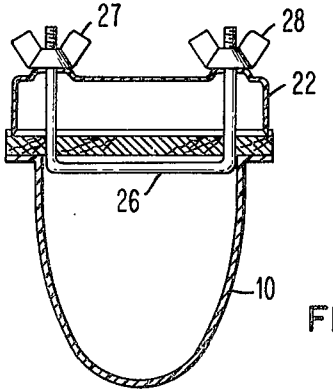
FIG. 3 is a sectional view taken along line A—A of FIG. 2.

Referring to the drawing, it is seen that the exercising device is an oval-shaped structure. The sectional view of FIG. 3 is a good illustration of this. Essentially, the device comprises a body portion 10 and a platform 11, extending into a relatively short ski portion 12. The length of the ski portion from the front side of the body 10 is so related that when the tip of the ski portion 12 touches the floor, the angle corresponds to that of a skier in a downhill position.

Continuing with the description, it is seen that the body portion 10 is solidly fastened to the platform 11 by means of bolts or rivets 13, 14, 15 and 16 so that it forms a solid and rigid assembly. Cutouts 18 and 19 in the body portion 10 allow the insertion of a strap 20. This is intended to be placed over the ski boot so that the latter is firmly attached to the platform 11.

The single strap 20 is sufficient to secure a boot to the platform 11, inasmuch as separate retaining means are provided for the heel as well as the toe of the boot.

Continuing with the description, it is seen that the heel abutting portion 22 is so constructed as to be slideable and thereby adjustable over the platform 11. Slots 23 and 24 are provided for this purpose. Upon sliding the heel portion 22 to the location where it will engage the particular size boot, the heel portion 22 may be secured by a rectangularly-shaped bolt 26 which extends through the heel portion 22 and has wing nuts 27 and 28 for fastening the latter to the platform 11. By the flexibility of adjustment of the heel portion 22, various size boots may be properly placed on the platform 11 in cooperation with clamping means of special construction provided for securing the toe of the boot.

As mentioned before, the platform 11 extends into a ski-shaped portion 12. The clamping means for securing the toe portion of the boot consists of a pair of vertically-extending rod-shaped members 30 and 31 terminating at one end in a semicircular offset portion 32. This clamping assembly is of such width that the members 30 and 31 may ride along the edges of the ski portion 12 in order to adjust the offset portion 32 to the point where it encircles the toe of the particular size boot placed on the platform 11. A plate 34 is placed as a reinforcement under the ski portion 12. It has holes to fit over the members 30 and 31 of the clamp 32. The clamping assembly may be tightened by the wing nuts of which only 36 can be seen in the illustrations.

The ability to move the clamp 32 along the sides of the ski portion 12, and to move the heel portion 22 over the platform 11, represents the salient features of the invention. By such an arrangement, boots of any given size may be properly placed on the platform 11. This is important for the exercises which are to be made by a person to develop such muscles which are necessary in the sport of skiing.

This invention in its broader aspects is not limited to the specific embodiment herein shown and described but changes may be made within the scope of the accompanying claims without sacrificing its chief advantages.

What is claimed is:

1. An exercising device for developing a user's leg muscles which are normally involved in skiing, said exercising device comprising:

a platform, said platform adapted to receive a ski boot worn by the user of said exercising device;

an oval shaped body portion secured beneath said platform, a ski portion of said platform extending forwardly of said oval shaped body at a first end of said platform;

boot toe retaining means adjustably secured on said ski portion of said platform, said toe retaining means including a semi-circular offset portion for engaging the boot toe and a pair of spaced vertical rods extending downwardly from said semi-circular portion on both sides of said ski portion, said vertical rods being slidable along said ski portion of said platform;

boot heel retaining means adjustably secured at a second end of said platform, said heel retaining means having a boot heel abutting portion secured on said platform by fastening means having vertical members extending through said platform and said heel abutting portion, and a horizontal member fitting under said platform; and a strap passing between said platform and said oval shaped body portion intermediate said toe and heel retaining means to secure the boot to the platform.

2. The exercising device of claim 1 wherein said vertical members of said heel retaining means pass through elongated slots in said platform, said vertical members being slidable in said slots to adjust the position of said heel retaining means on said platform.

3. The exercising device of claim 1 wherein said strap passes through cut-out portions of said oval shaped body.

4. The exercising device of claim 1 wherein said spaced vertical rods extend downwardly through a reinforcing plate which extends under said ski portion of said platform.

* * * * *